US008970321B2

(12) United States Patent
Kawamura et al.

(10) Patent No.: US 8,970,321 B2
(45) Date of Patent: Mar. 3, 2015

(54) MILLIMETER WAVEBAND FILTER AND METHOD OF INCREASING REJECTION BAND ATTENUATION

(71) Applicant: Anritsu Corporation, Kanagawa (JP)

(72) Inventors: Takashi Kawamura, Kanagawa (JP); Akihito Otani, Kanagawa (JP)

(73) Assignee: Anritsu Corporation, Kanagawa (JP)

( * ) Notice: Subject to any disclaimer, the term of this patent is extended or adjusted under 35 U.S.C. 154(b) by 94 days.

(21) Appl. No.: 13/927,284

(22) Filed: Jun. 26, 2013

(65) Prior Publication Data

US 2014/0015626 A1 Jan. 16, 2014

(30) Foreign Application Priority Data

Jul. 10, 2012 (JP) ..... 2012-154326

(51) Int. Cl.

| | |
|---|---|
| ***H01P 1/161*** | (2006.01) |
| ***H01P 1/20*** | (2006.01) |
| ***H01P 1/162*** | (2006.01) |
| ***H01P 1/208*** | (2006.01) |

(52) U.S. Cl.

CPC *H01P 1/20* (2013.01); *H01P 1/162* (2013.01); *H01P 1/2082* (2013.01)

USPC ..... 333/135; 333/126; 333/21 R; 333/121; 333/122

(58) Field of Classification Search

USPC ..... 333/117–137, 202–212

See application file for complete search history.

(56) References Cited

U.S. PATENT DOCUMENTS

| | | | | |
|---|---|---|---|---|
| 2003/0006866 | A1* | 1/2003 | Yoneda et al. | 333/212 |
| 2004/0145426 | A1* | 7/2004 | Wu et al. | 333/26 |
| 2009/0237092 | A1* | 9/2009 | Zoughi et al. | 324/637 |
| 2012/0098594 | A1* | 4/2012 | Zmuidzinas et al. | 330/4.6 |
| 2013/0135063 | A1* | 5/2013 | Kawamura et al. | 333/209 |
| 2013/0314179 | A1* | 11/2013 | Kawamura et al. | 333/208 |
| 2014/0015626 | A1* | 1/2014 | Kawamura et al. | 333/209 |

OTHER PUBLICATIONS

Teshirogi, Tasuku et al. "Moder-Millimeter-Wave Technologies" In: Wave Summit Course, 2001; pp. 68-69.

* cited by examiner

*Primary Examiner* — Brandon S Cole

(74) *Attorney, Agent, or Firm* — Pearne & Gordon LLP

(57) ABSTRACT

A millimeter waveband filter is provided with a resonator formed by a pair of electric wave half mirrors in a transmission line of a waveguide allowing electromagnetic waves in a predetermined frequency range of a millimeter waveband to propagate in a TE10 mode, and allows frequency components centering on the resonance frequency of the resonator to pass therethrough. A high-pass filter which has a transmission line reduced in size so as to have a cutoff frequency matching an upper limit of a lower rejection band of a filter passband is formed in a transmission line between the end of the waveguide and the electric wave half mirror, thereby increasing the attenuation of the lower rejection band.

8 Claims, 5 Drawing Sheets

MILLIMETER WAVEBAND FILTER AND METHOD OF INCREASING REJECTION BAND ATTENUATION

TECHNICAL FIELD

The present invention relates to a filter which is used in a millimeter waveband.

BACKGROUND ART

In recent years, there is an increasing need for the use of electric waves in response to a ubiquitous network society, and a wireless personal area network (WPAN) which realizes wireless broadband at home or a millimeter waveband wireless system, such as a millimeter-wave radar, which supports safe and secure driving starts to be used. An effort to realize a wireless system at a frequency equal to or greater than 100 GHz is actively made.

In regard to second harmonic evaluation of a wireless system in a 60 to 70 GHz band or evaluation of a radio signal in a frequency band equal to or greater than 100 GHz, as the frequency becomes high, the noise level of a measurement device and conversion loss of a mixer increase and frequency precision is lowered. For this reason, a high-sensitivity and high-precision technology of a radio signal over 100 GHz has not been established. In the conventional measurement technologies, it is not possible to separate harmonics of local oscillation from the measurement result, and there is difficulty in strict measurement of unnecessary emission or the like.

In order to overcome the problems in the related art and to realize high-sensitivity and high-precision measurement of a radio signal in a frequency band equal to or greater than 100 GHz, it is necessary to develop a narrowband filter technology of a millimeter waveband for the purpose of suppressing an image response and a high-order harmonic response, and in particular, there is a demand for a technology which is adaptable to a variable frequency type (tunable).

Hitherto, as a filter which is used as a frequency variable type in a millimeter waveband, (a) a filter using a YIG resonator, (b) a filter with a varactor diode attached to a resonator, and (c) a Fabry-Perot resonator are known.

As the filter using a YIG resonator of (a), a filter which can be used up to about 80 GHz is known in the present situation, and as the filter with a varactor diode attached to a resonator of (b), a filter which can be used up to about 40 GHz is known. Meanwhile, manufacturing gets difficulty at a frequency over 100 GHz.

In contrast, the Fabry-Perot resonator of (c) is well used in an optical field, and a technology which uses the Fabry-Perot resonator for millimeter waves is disclosed in Non-Patent Document 1. Non-Patent Document 1 describes a confocal Fabry-Perot resonator in which a pair of spherical mirrors reflecting millimeter waves are arranged to face each other at the same interval as the radius of curvature, thereby realizing high Q.

RELATED ART DOCUMENT

Non-Patent Document

Non-Patent Document 1 Tasuku Teshirogi and Tsukasa Yoneyama, "Modern millimeter-wave technologies", Ohmsha, 1993, p 71

SUMMARY OF THE INVENTION

Problem that the Invention is to Solve

However, in the confocal Fabry-Perot resonator, when the distance between the mirror surfaces is moved so as to tune a passband, it is expected that, in principle, the focus is shifted and then Q is significantly lowered. Accordingly, a pair of mirrors which are different in curvature depending on the frequency should be selectively used.

As a Fabry-Perot resonator which is used in the optical field, a structure in which parallel-plate half mirrors are arranged to face each other is known. With this structure, in principle, even if the distance between the mirror surfaces is changed, Q is not lowered. Meanwhile, in order to realize a filter using the parallel-plate Fabry-Perot resonator in a millimeter waveband, there are the following problems which should be solved.

(A) It is necessary to input plane waves in parallel to the half mirrors. When an input to the filter is a waveguide, while it is considered that the diameter becomes large like a horn antenna to realize plane waves, the size increases. In this case, complete plane waves are not easily realized, and characteristics are deteriorated.

(B) The half mirrors should have a function of transmitting a given amount of plane waves directly. For this reason, there are restrictions on the structure of the half mirrors, and flexibility for design is low.

(C) Since the filter is of an open type, loss by space emission is large.

As a millimeter waveband filter which solves the above-described problem, as shown in FIG. 7, a structure is considered in which, inside a transmission line la which is formed by a waveguide 1 allowing electromagnetic waves in a predetermined frequency range of a millimeter waveband to propagate from one end to the other end in a TE10 mode, a pair of flat electric wave half mirrors 2 and 3 having characteristics to transmit a part of the electromagnetic waves in the predetermined frequency range and to reflect a part of the electromagnetic waves are arranged to face each other at an interval, and frequency components centering on the resonance frequency of a resonator formed between the pair of electric wave half mirrors are selectively transmitted.

With the above-described structure, it is possible to suppress characteristic deterioration by wavefront conversion, to give a high flexibility for design of the electric wave half mirrors, and to reduce loss by space emission.

The electrical length between the pair of electric wave half mirrors 2 and 3 is changed, whereby the resonance frequency of the resonator can be variable. For this reason, it is preferable to use a mechanism which varies the interval of the pair of the electric wave half mirrors.

On the other hand, when manufacturing a frequency variable type millimeter waveband filter based on the above-described principle in practice, there are other problems which should be solved.

That is, when rejection band attenuation by a resonance type filter becomes insufficient, in the related art, filters are connected in a multistage manner. Meanwhile, as described above, in the case of a filter having a structure in which a pair of electric wave half mirrors are arranged to face each other in the transmission line of the waveguide, if the filters are connected in a multistage manner so as to increase the rejection band attenuation, the filters interfere each other, making it difficult to obtain a desired characteristic.

FIG. 8 shows the frequency characteristic (S21) of a filter having a basic structure in which a pair of electric wave half mirrors are arranged to face each other in the transmission line of the waveguide. For example, when a frequency variable width is ±16 GHz centering on a resonance frequency (about 124 GHz) having an upward convex peak, the attenuation of a rejection band lower (equal to or smaller than about 108 GHz) or higher (equal to or greater than about 140 GHz) than the resonance frequency becomes about −50 dB, and if there is an unnecessary signal at high level in the rejection band, the signal is output from the filter without undergoing sufficient attenuation.

If the filters having this characteristic are connected in a multistage manner, a resonance phenomenon occurs between a pair of electric wave half mirrors constituting one filter and a pair of half mirrors constituting the other filter, whereby a desired frequency characteristic is not obtained.

The invention has been accomplished in order to solve the above-described problem, and an object of the invention is to provide a millimeter waveband filter and a method of increasing rejection band attenuation of a millimeter waveband filter capable of suppressing characteristic deterioration by wavefront conversion, giving a high flexibility for design of electric wave half mirrors, reducing loss by space radiation, and increasing rejection band attenuation of the filter.

Means for Solving the Problem

In order to attain the above-described object, a millimeter waveband filter according to a first aspect of the invention includes a waveguide (21, 21A, 21B) which has a transmission line allowing electromagnetic waves in a predetermined frequency range of a millimeter waveband to propagate from one end to the other end in a TE10 mode, a pair of electric wave half mirrors (40A, 40B) which have characteristics to transmit a part of the electromagnetic waves in the predetermined frequency range and to reflect a part of the electromagnetic waves, are arranged to face each other at an interval in an intermediate portion of the transmission line of the waveguide, and have a resonator formed therebetween, a resonance frequency variable means (50) which varies the resonance frequency of the resonator formed between the pair of electric wave half mirrors, and a high-pass filter (30) which is provided in the transmission line between the end of the waveguide and the electric wave half mirror, and has a transmission line reduced in size so as to have a cutoff frequency at a frequency close to the lower limit of the filter passband in a rejection band lower than a filter passband corresponding to a variable range of the resonance frequency.

According to a second aspect of the invention, the millimeter waveband filter according to the first aspect of the invention further includes a band rejection filter (35) which has a choke groove (36) having a predetermined depth formed around the inner wall of the high-pass filter, and attenuates components of a rejection band higher than the filter passband from among the electromagnetic waves passing through the high-pass filter.

According to a third aspect of the invention, in the millimeter waveband filter according to the first aspect of the invention, one of the pair of electric wave half mirrors is fixed to one of two waveguides in which a transmission line is continuous and which are slidably connected together in a state where one waveguide is inserted into the other waveguide, the other electric wave half mirror of the pair of electric wave half mirrors is fixed to the other waveguide of the two waveguides (21A, 21B), and the resonance frequency variable means varies the resonance frequency by sliding one of the two waveguides with respect to the other waveguide.

According to a fourth aspect of the invention, in the millimeter waveband filter according to the second aspect of the invention, one of the pair of electric wave half mirrors is fixed to one of two waveguides in which a transmission line is continuous and which are slidably connected together in a state where one waveguide is inserted into the other waveguide, the other electric wave half mirror of the pair of electric wave half mirrors is fixed to the other waveguide of the two waveguides, and the resonance frequency variable means varies the resonance frequency by sliding one of the two waveguides with respect to the other waveguide.

According to a fifth aspect of the invention, in the millimeter waveband filter according to the first aspect of the invention, the resonance frequency variable means varies the resonance frequency by varying the interval between wall surfaces (25*c*,25*d*) along the short side of a transmission line (22*b*) having a rectangular sectional shape between the pair of electric wave half mirrors.

According to a sixth aspect of the invention, in the millimeter waveband filter according to the second aspect of the invention, the resonance frequency variable means varies the resonance frequency by varying the interval between wall surfaces along the short side of a transmission line having a rectangular sectional shape between the pair of electric wave half mirrors.

According to a seventh aspect of the invention, there is provided a method of increasing rejection band attenuation outside a filter passband corresponding to a variable range of a resonance frequency of a millimeter waveband filter, in which the millimeter waveband filter includes a waveguide (21, 21A, 21B) which has a transmission line allowing electromagnetic waves in a predetermined frequency range of a millimeter waveband to propagate from one end to the other end in a TE10 mode, a pair of electric wave half mirrors (40A, 40B) which have characteristics to transmit a part of the electromagnetic waves in the predetermined frequency range and to reflect a part of the electromagnetic waves, are arranged to face each other at an interval in an intermediate portion of the transmission line of the waveguide, and have a resonator formed therebetween, and a resonance frequency variable means (50) which varies the resonance frequency of the resonator formed between the pair of electric wave half mirrors, and a high-pass filter (30) which has a transmission line reduced in size so as to have a cutoff frequency at a frequency close to the lower limit of the filter passband in a rejection band lower than the filter passband is provided in the transmission line between the end of the waveguide and the electric wave half mirror to increase the attenuation of the rejection band lower than the filter passband.

According to a eighth aspect of the invention, in the method of increasing rejection band attenuation of a millimeter waveband filter according to the seventh aspect of the invention, a band rejection filter (35) which has a choke groove (36) having a predetermined depth formed around the inner wall of the high-pass filter is provided to increase the attenuation of a rejection band higher than the filter passband from among the electromagnetic waves passing through the high-pass filter.

Advantage of the Invention

As described above, since a structure in which a resonator formed by a pair of electric wave half mirrors is provided in a continuous transmission line allowing transmission only in a TE10 mode is made, a special device for inputting plane waves is not required, and the electric wave half mirrors do not need to transmit plane waves and may have an arbitrary shape.

The filter is of a closed type as a whole, and thus there is no loss by emission to the external space in principle. Therefore, very high selection characteristics can be realized in the millimeter waveband.

The high-pass filter is formed in the transmission line between the end of the waveguide and the electric wave half mirror so as to have the cutoff frequency matching the upper limit of the lower rejection band of the filter passband, whereby it is possible to significantly increase the attenuation of the rejection band lower than the filter passband without seriously affecting the passband characteristics of the filter.

The choke groove provided in the inner wall of the high-pass filter forms the band rejection filter which inhibits the passage of electromagnetic waves of the higher rejection band, whereby it is possible to significantly increase the attenuation of the rejection band higher than the filter passband without seriously affecting the passband characteristics of the filter.

MODE FOR CARRYING OUT THE INVENTION

Figure 1:
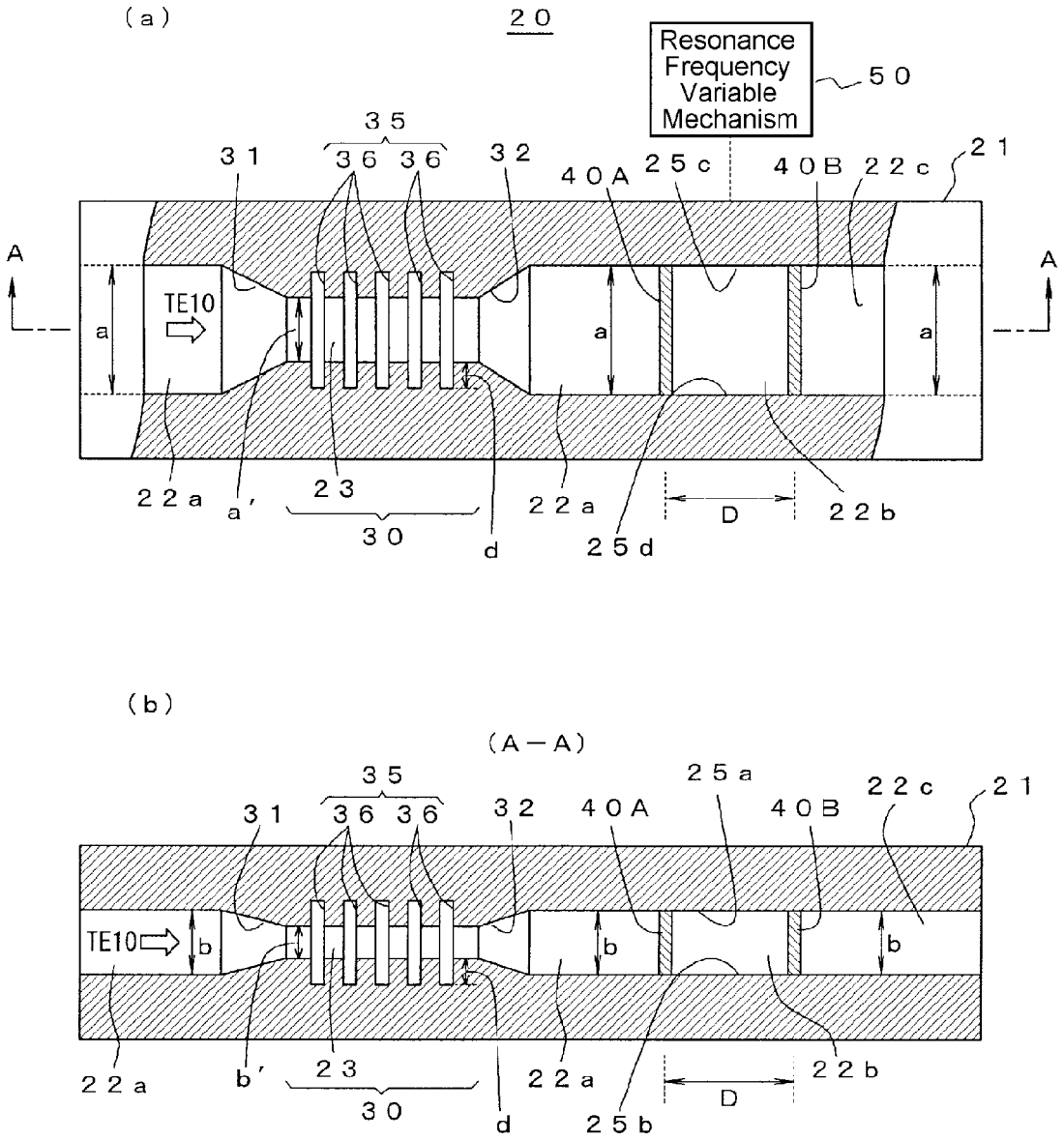
FIGS. 1A and 1B are diagrams showing the basic structure of a millimeter waveband filter according to the invention.

Hereinafter, an embodiment of the invention will be described referring to the drawings.

FIGS. 1A and 1B show the basic structure of a millimeter waveband filter 20 according to the invention.

As shown in a side view of FIG. 1A, the millimeter waveband filter 20 has a waveguide 21, a pair of electric wave half mirrors 40A and 40B, and a resonance frequency variable mechanism 50 as a resonance frequency variable means.

The waveguide 21 has a hollow rectangular column, and a transmission line 22 which has a rectangular sectional shape and is of size (for example, standard size a×b=2.032 mm×1.016 mm) allowing electromagnetic waves in a predetermined frequency range (for example, 110 to 140 GHz) of a millimeter waveband to propagate only in a TE10 mode is formed continuously from one end to the other end excluding a portion corresponding to a high-pass filter 30 described below.

In the waveguide 21, a pair of electric wave half mirrors 40A and 40B which have characteristics to transmit a part of the electromagnetic waves in the predetermined frequency range and to reflect a part of the electromagnetic waves are arranged to face each other at an interval D (for example, about 1.4 mm) so as to block the inside of the transmission line 22. Accordingly, the transmission line 22 is divided into a first transmission line 22*a* from one end (in the drawing, the left end) to the electric wave half mirror 40A, a second transmission line 22*b* between the electric wave half mirrors 40A and 40B, and a third transmission line 22*c* from the electric wave half mirror 40B to the other end (in the drawing, the right end).

Figure 2:
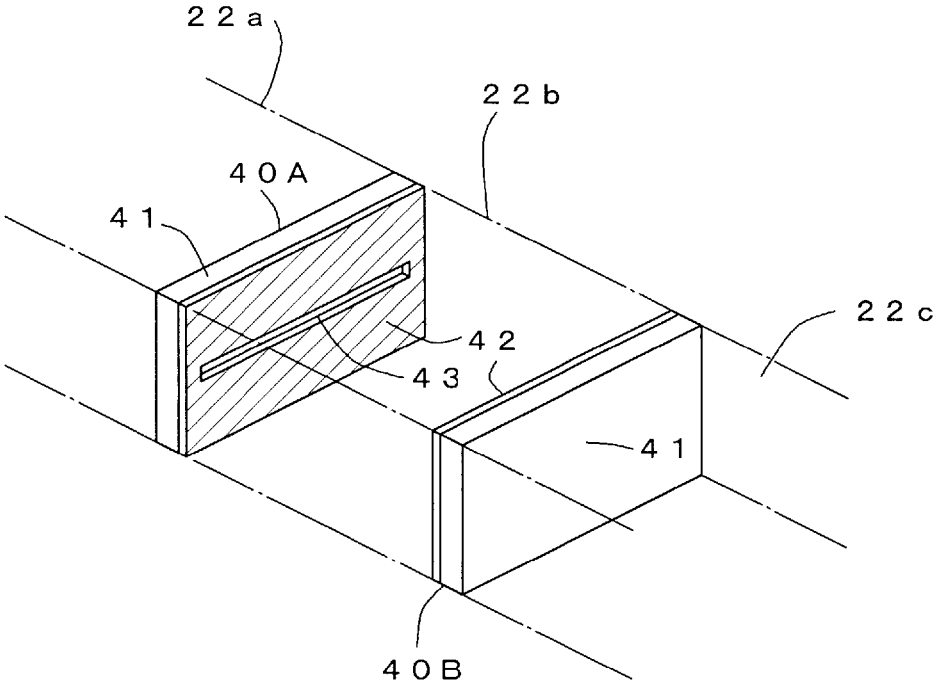
FIG. 2 is a diagram showing a structure example of an electric wave half mirror.

For example, as shown in FIG. 2, each of a pair of electric wave half mirrors 40A and 40B has a rectangular dielectric substrate 41 which is of size corresponding to the size of the transmission line, to which the electric wave half mirror is fixed, a metal film 42 which covers the surface of the dielectric substrate 41, and an electromagnetic wave transmitting slit 43 which is provided in the metal film 42. Each of the electric wave half mirrors 40A and 40B is fixed in a state where the outer circumference of the metal film 42 is in contact with the inner wall of the transmission line, and transmits the electromagnetic waves with transmittance corresponding to the shape or area of the slit 43.

In the millimeter waveband filter 20 having this basic structure, a parallel-plate Fabry-Perot resonator is formed by a pair of electric wave half mirrors 40A and 40B, and only frequency components centering on the resonance frequency of the resonator can be selectively transmitted.

The transmission line 22 is formed to have a waveguide structure as a closed transmission path with very low loss in the millimeter waveband, and is of size allowing transmission only in a TE10 mode. For this reason, processing, such as wavefront conversion, is not required, and only a signal component extracted by the resonator can be output with very low loss.

The resonance frequency variable mechanism 50 is a mechanism which varies the resonance frequency of the resonator formed by a pair of electric wave half mirrors 40A and 40B and the second transmission line 22*b* between a pair of electric wave half mirrors 40A and 40B. As the varying methods, there are a method which varies the physical interval D or electrical (for example, by a variable dielectric constant of a dielectric) interval between a pair of electric wave half mirrors 40A and 40B, and a method which varies the interval between sidewalls along the short side of the second transmission line 22*b* interposed between the electric wave half mirrors 40A and 40B, and any method may be used. The specific structure will be described below.

In this way, since a structure in which the resonator formed by a pair of flat electric wave half mirrors 40A and 40B is provided in the transmission line allowing transmission in the TE10 mode is made, a special device for inputting plane waves is not required, and the electric wave half mirrors do not need to transmit plane waves and may have an arbitrary shape.

The filter is of a closed type as a whole, and thus loss by emission to the external space is low. Therefore, very high selection characteristics can be realized in the millimeter waveband.

Figure 8:
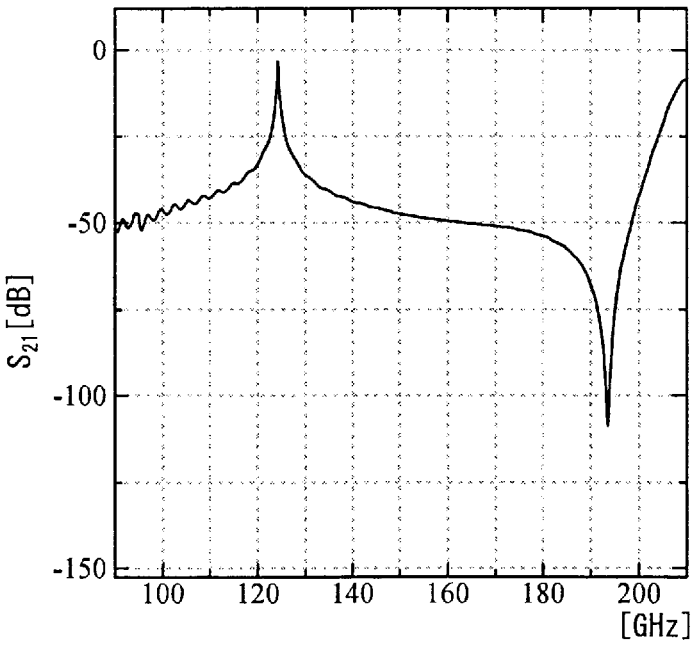
FIG. 8 shows a simulation result of filter characteristics of the structure of FIG. 7.

On the other hand, when the structure of the waveguide 21 is of uniform size over the entire length thereof, like the characteristic shown in FIG. 8, the attenuation of a rejection band outside a filter passband to be obtained by varying the resonance frequency is not sufficient, making it not possible to sufficiently remove an unnecessary signal at high level outside the filter passband. As described above, if a plurality of electric wave half mirrors are provided and connected in a multistage manner, the filters interfere each other, making it difficult to obtain a desired characteristic.

In order to solve this problem, in the millimeter waveband filter 20 of the embodiment, a high-pass filter 30 which is formed by a transmission line 23 continuous at a predetermined length (for example, 15 mm) with size (for example, size a'×b'=1.415 mm×0.708 mm) smaller than the first transmission line 22*a* so as to have a cutoff frequency at a frequency close to the lower limit of the filter passband in a rejection band lower than the filter passband is provided in the first transmission line 22*a* between one end of the waveguide 21 and the electric wave half mirror 40A. The cutoff wavelength of a TE10 mode of a transmission line of size 1.415 mm×0.708 mm is 1.415 mm×2=2.83 mm, and becomes about 106 GHz in terms of frequency.

The two transmission lines 22*a* and 23 which are different in size are connected through tapered portions 31 and 32 which have size continuously changing in a range of a predetermined length (for example, 5 mm), thereby preventing the occurrence of unwanted reflection.

A plurality of choke grooves 36 having a depth d are formed around the inner wall of the high-pass filter 30, and a plurality of choke grooves 36 form a band rejection filter 35 which attenuates components of a rejection band higher than the filter passband from among the electromagnetic waves passing through the transmission line 23 of the high-pass filter 30.

The choke grooves 36 have an operation to attenuate components of a wavelength λg (=4d) to be determined by the depth d, and a plurality of choke grooves are formed while changing the depth, whereby the rejection band can be widened.

Although in FIGS. 1A and 1B, for ease of drawing, five choke grooves are shown, in the example, seven choke grooves 36 having a width of 0.2 mm and the depth d of 0.36, 0.38, 0.40, 0.42, 0.44, 0.46, and 0.48 mm are provided at an interval (groove center interval) of 0.35 mm in the propagation direction.

Here, the rejection wavelength when the depth d=0.48 mm is 1.92 mm and becomes about 156 GHz in terms of frequency, and the rejection wavelength when the depth d=0.36 mm is 1.44 mm and becomes about 208 GHz in terms of frequency, whereby the band components of 156 to 208 GHz can be attenuated in the above numerical examples.

In this way, the high-pass filter 30 which has the cutoff frequency close to the upper limit frequency of a rejection band lower than the filter passband is provided, and the band rejection filter 35 which has a plurality of choke grooves 36 for attenuating the components of the rejection band higher than the filter passband are provided in the inner wall of the high-pass filter 30. Therefore, it is not necessary to introduce a multistage connection structure of a plurality of pairs of electric wave half mirrors, and it is possible to significantly increase the attenuation of the lower and higher rejection bands.

Figure 3:
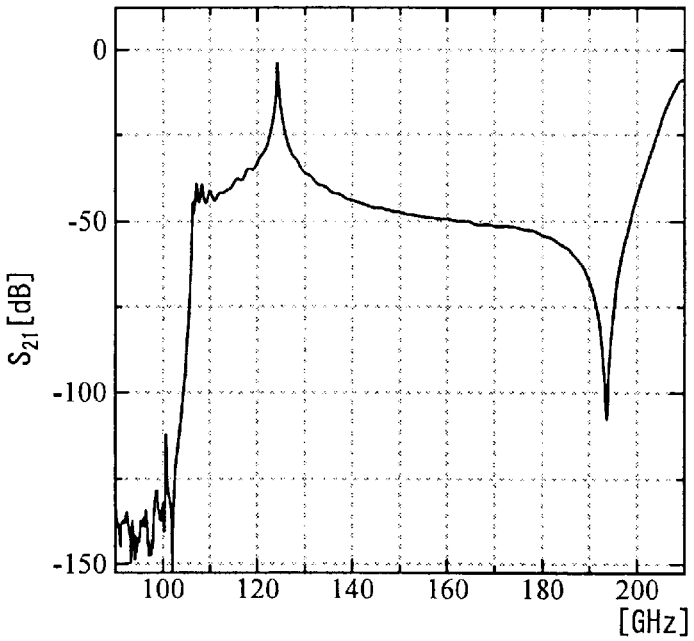
FIG. 3 shows a simulation result of filter characteristics when only a high-pass filter is provided.

FIG. 3 shows a simulation result of a frequency characteristic (S21) using the numerical examples when only the high-pass filter 30 is provided in the waveguide 21. When a frequency variable width (filter passband) is, for example, ±16 GHz centering on a resonance frequency (about 124 GHz) having an upward convex peak, the attenuation of a rejection band lower (equal to or smaller than about 108 GHz) than the resonance frequency becomes equal to or smaller than −110 dB, and it is understood that an unnecessary signal at high level in the rejection band can be sufficiently attenuated.

Figure 4:
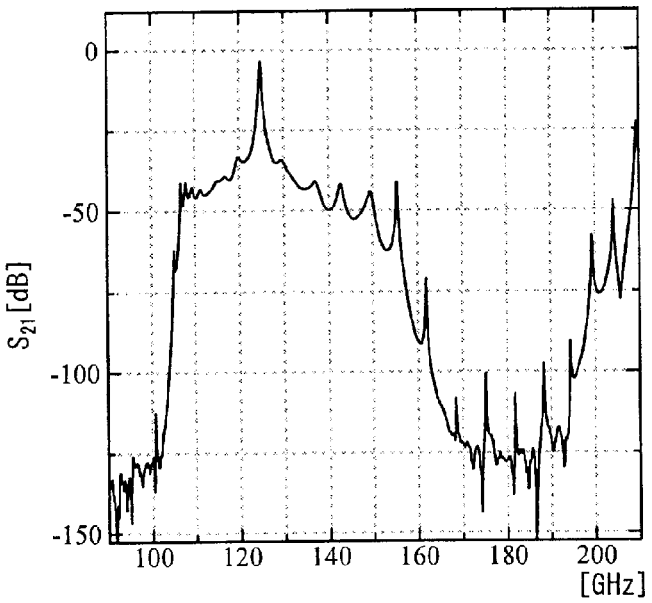
FIG. 4 shows a simulation result of filter characteristics when a high-pass filter and a band rejection filter are provided.

FIG. 4 shows a simulation result of a frequency characteristic (S21) using the numerical examples when the high-pass filter 30 and the band rejection filter 35 are provided in the waveguide 21. The attenuation of the rejection band lower (equal to or smaller than about 108 GHz) than the filter passband becomes equal to or smaller than −110 dB by the high-pass filter 30, the attenuation of the higher (about 162 GHz to 190 GHz) rejection band increases to be equal to or smaller than −100 dB, and it is understood that unnecessary signals at high level in the rejection bands can be sufficiently attenuated.

Although in the above example, the high-pass filter 30 and the band rejection filter 35 are provided in the transmission line between one end of the waveguide 21 and the electric wave half mirror 40A, the high-pass filter 30 and the band rejection filter 35 may be provided between the other end of the waveguide 21 and the electric wave half mirror 40B or may be provided on both sides of a pair of electric wave half mirrors 40A and 40B.

When intensively increasing the attenuation of the lower rejection band, the band rejection filter 35 may not be provided.

Figure 5:
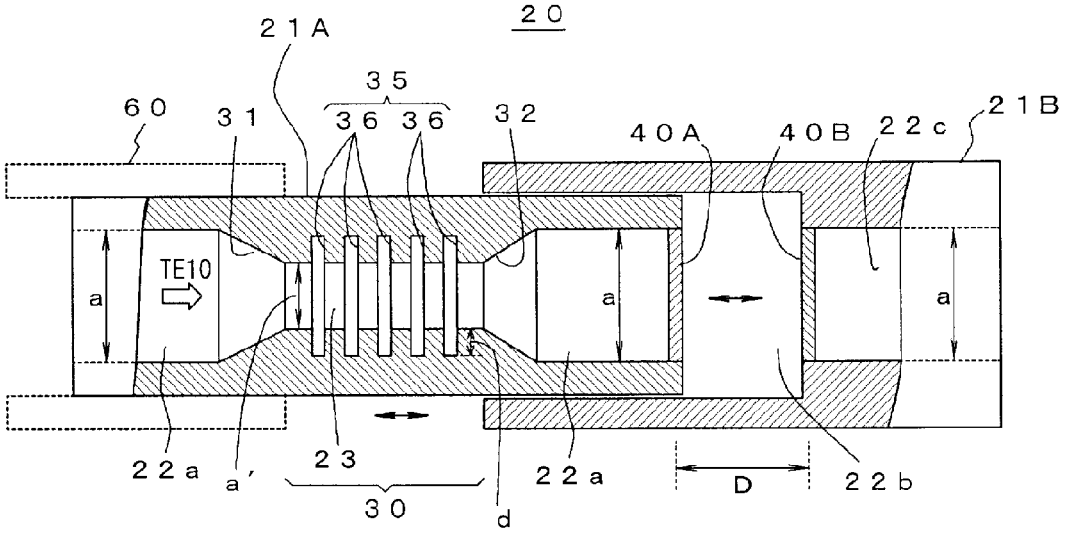
FIG. 5 is a diagram illustrating an example of a resonance frequency variable mechanism.

Next, a configuration example for varying the resonance frequency will be described. FIG. 5 shows a structure example where the resonance frequency is variable by mechanically varying the interval D between the electric wave half mirrors 40A and 40B. The waveguide 21 has two waveguides 21A and 21B in which a transmission line is continuous and which are slidably connected in a state where one waveguide is inserted into the other waveguide, the electric wave half mirror 40A is fixed to the leading end of the waveguide 21A, and the electric wave half mirror 40B is fixed to the intermediate portion of the waveguide 21B which has a different-diameter structure and receives the electric wave half mirror 40A at one end.

In this structure, the waveguide 21A slides with respect to the waveguide 21B to change the interval D between a pair of electric wave half mirrors 40A and 40B, thereby changing the resonance frequency (a driving device is not shown).

However, since one waveguide moves in the propagation direction of the electromagnetic waves, one of filters connected before and after the filter follows the filter. In order to solve this, a buffer portion (for example, a fixed waveguide represented by reference numeral 60 of FIG. 5) which absorbs the movement of the waveguide is required between the filter and an external circuit. For this reason, although the length of the waveguide (in this example, the waveguide 21A) on a movable side increases, it should suffice that the high-pass filter 30 and the band rejection filter 35 are provided using a portion corresponding to the increased length.

Figure 6:
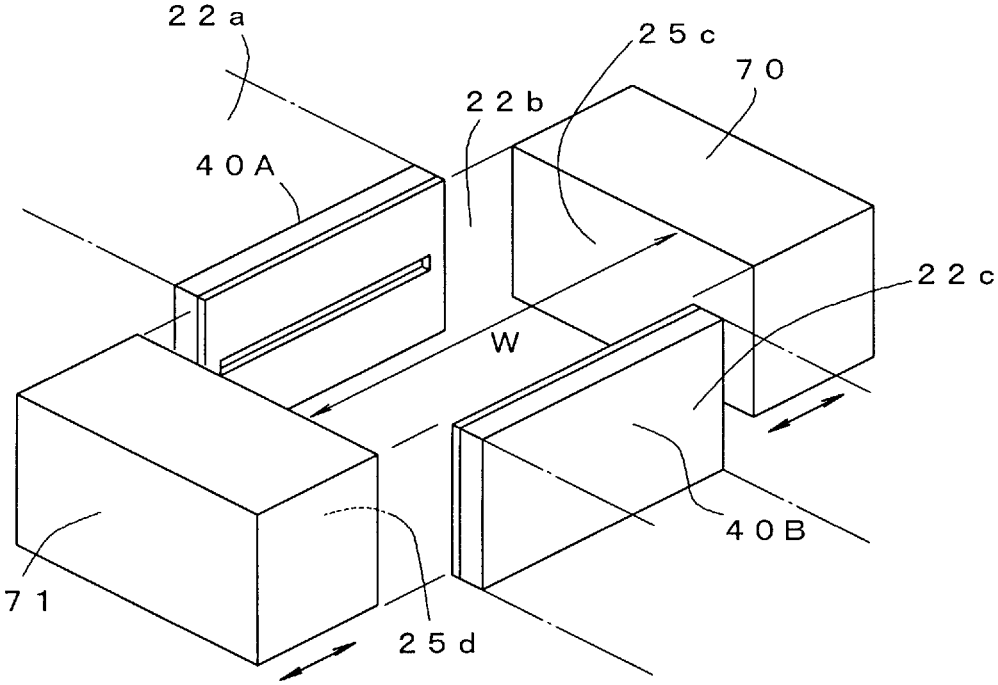
FIG. 6 is a diagram illustrating another example of a resonance frequency variable mechanism.
Figure 7:
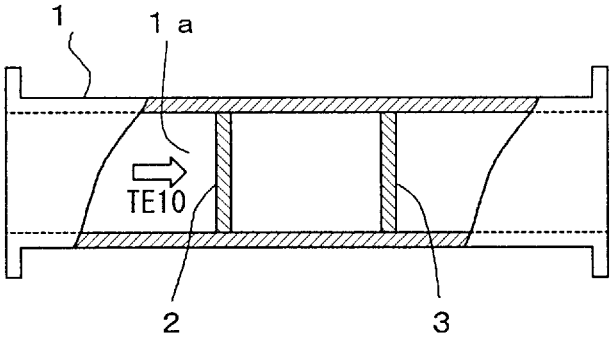
FIG. 7 is a principle configuration diagram of a millimeter waveband filter which is fundamental to the invention.

Although in the above example, the resonance frequency is variable by varying the interval D between the electric wave half mirrors 40A and 40B, as shown in a main part of FIG. 6, from among four wall surfaces 25*a* to 25*d* (see FIGS. 1A and 1B) which surround the second transmission line 22*b* having a rectangular sectional shape between the electric wave half mirrors 40A and 40B at a fixed interval, the resonance frequency can be variable by moving rectangular parallelepiped movable blocks 70 and 71 having the wall surfaces 25*c* and 25*d* along the short side as opposing surfaces such that the interval W between the wall surfaces 25*c* and 25*d* changes (a driving device is not shown).

That is, it is known that the guide wavelength λg of the waveguide is expressed by the following expression.

$$\lambda g=\lambda/[1-(\lambda/\lambda_{C10})^2]^{1/2}=\lambda/[1-(\lambda/2W)^2]^{1/2}$$

λ: free space wavelength $\lambda_{C10}$: cutoff frequency of TE10 mode

W: long side of aperture of waveguide

Since the resonance wavelength (the center wavelength of the passband) of a filter having a structure, in which the electric wave half mirrors 40A and 40B are arranged to face each other, becomes ½ of the guide wavelength λg, the resonance frequency of the filter can be varied by varying the long side of the second transmission line 22*b*, that is, the interval W of the sidewall surfaces 25*c* and 25*d* along the short side of the second transmission line 22*b*. Here, although a case where both sidewall surfaces 25*c* and 25*d* are moved has been described, one sidewall surface may be moved.

When this resonance frequency variable mechanism is used, since the length in the electromagnetic wave propagation direction of the filter is not changed, the above-described buffer waveguide is not required.

DESCRIPTION OF REFERENCE NUMERALS AND SIGNS

20: millimeter waveband filter, 21, 21A, 21B: waveguide, 22, 23: transmission line, 30: high-pass filter, 35: band rejection filter, 36: choke groove, 40A, 40B: electric wave half mirror, 50: resonance frequency variable mechanism, 60: fixed waveguide, 70, 71: movable block

The invention claimed is:

1. A millimeter waveband filter comprising:

a waveguide which has a transmission line allowing electromagnetic waves in a predetermined frequency range of a millimeter waveband to propagate from one end to the other end in a TE10 mode;

a pair of electric wave half mirrors which have characteristics to transmit a part of the electromagnetic waves in the predetermined frequency range and to reflect a part of the electromagnetic waves, are arranged to face each other at an interval in an intermediate portion of the transmission line of the waveguide, and have a resonator formed therebetween;

a resonance frequency variable means which varies the resonance frequency of the resonator formed between the pair of electric wave half mirrors; and a high-pass filter which is provided in the transmission line between the end of the waveguide and the electric wave half mirror, and has a transmission line reduced in size so as to have a cutoff frequency at a frequency in a rejection band lower than a filter passband corresponding to a variable range of the resonance frequency.

2. The millimeter waveband filter according to claim 1, further comprising:

a band rejection filter which has a choke groove having a predetermined depth formed around the inner wall of the high-pass filter, and attenuates components of a rejection band higher than the filter passband from among the electromagnetic waves passing through the high-pass filter.

3. The millimeter waveband filter according to claim 2, wherein one of the pair of electric wave half mirrors is fixed to one of two waveguides in which a transmission line is continuous and which are slidably connected together in a state where one waveguide is inserted into the other waveguide, the other electric wave half mirror of the pair of electric wave half mirrors is fixed to the other waveguide of the two waveguides, and the resonance frequency variable means varies the resonance frequency by sliding one of the two waveguides with respect to the other waveguide.

4. The millimeter waveband filter according to claim 2, wherein the resonance frequency variable means varies the resonance frequency by varying the interval between wall surfaces along the short side of a transmission line having a rectangular sectional shape between the pair of electric wave half mirrors.

5. The millimeter waveband filter according to claim 1, wherein one of the pair of electric wave half mirrors is fixed to one of two waveguides in which a transmission line is continuous and which are slidably connected together in a state where one waveguide is inserted into the other waveguide, the other electric wave half mirror of the pair of electric wave half mirrors is fixed to the other waveguide of the two waveguides, and the resonance frequency variable means varies the resonance frequency by sliding one of the two waveguides with respect to the other waveguide.

6. The millimeter waveband filter according to claim 1, wherein the resonance frequency variable means varies the resonance frequency by varying the interval between wall surfaces along the short side of a transmission line having a rectangular sectional shape between the pair of electric wave half mirrors.

7. A method of increasing rejection band attenuation outside a filter passband corresponding to a variable range of a resonance frequency of a millimeter waveband filter, wherein the millimeter waveband filter includes a waveguide which has a transmission line allowing electromagnetic waves in a predetermined frequency range of a millimeter waveband to propagate from one end to the other end in a TE10 mode, a pair of electric wave half mirrors which have characteristics to transmit a part of the electromagnetic waves in the predetermined frequency range and to reflect a part of the electromagnetic waves, are arranged to face each other at an interval in an intermediate portion of the transmission line of the waveguide, and have a resonator formed therebetween;

a resonance frequency variable means which varies the resonance frequency of the resonator formed between the pair of electric wave half mirrors, and a high-pass filter which has a transmission line reduced in size so as to have a cutoff frequency at a frequency in a rejection band lower than the filter passband is provided in the transmission line between the end of the waveguide and the electric wave half mirror to increase the attenuation of the rejection band lower than the filter passband.

8. The method according to claim 7, wherein a band rejection filter which has a choke groove having a predetermined depth formed around the inner wall of the high-pass filter is provided to increase the attenuation of a rejection band higher than the filter passband from among the electromagnetic waves passing through the high-pass filter.

* * * * *